US008260178B2

(12) United States Patent
Kuroyama

(10) Patent No.: US 8,260,178 B2
(45) Date of Patent: Sep. 4, 2012

(54) TONER CARTRIDGE AND IMAGE FORMING APPARATUS

(75) Inventor: Koichi Kuroyama, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 290 days.

(21) Appl. No.: 12/826,032

(22) Filed: Jun. 29, 2010

(65) Prior Publication Data

US 2011/0008076 A1 Jan. 13, 2011

Related U.S. Application Data

(60) Provisional application No. 61/223,852, filed on Jul. 8, 2009.

(51) Int. Cl.
*G03G 15/08* (2006.01)

(52) U.S. Cl. ..... 399/263; 399/111

(58) Field of Classification Search ..... 399/107, 399/110, 111, 119, 120, 252–263
See application file for complete search history.

(56) References Cited

U.S. PATENT DOCUMENTS

| | | | | |
|---|---|---|---|---|
| 6,229,976 | B1 * | 5/2001 | Kimura | 399/262 |
| 7,720,418 | B2 * | 5/2010 | Tanaka et al. | 399/263 |
| 8,139,989 | B2 * | 3/2012 | Ohgoshi et al. | 399/263 |
| 2007/0231017 | A1 | 10/2007 | Sato | |

* cited by examiner

*Primary Examiner* — Hoan Tran
(74) *Attorney, Agent, or Firm* — Turocy & Watson, LLP

(57) ABSTRACT

According to one embodiment, a toner cartridge includes a cartridge body, a stirring member configured to stir toner contained in the cartridge body, and a scraping member having elasticity. The stirring member includes a rotation shaft contained in the cartridge body, and plural stirring rods protruded from the rotation shaft and arranged in an axial direction of the rotation shaft. The stirring rods have tips opposite to an inner surface of the cartridge body. The tips of the stirring rods are separate from each other. The scraping member extends in the axial direction of the rotation shaft to scrape toner adhered to the inner surface of the cartridge body, and includes plural elastically deformable strips divided along the axial direction of the rotation shaft.

14 Claims, 7 Drawing Sheets

TONER CARTRIDGE AND IMAGE FORMING APPARATUS

CROSS-REFERENCE TO RELATED APPLICATIONS

This application claims the benefit of U.S. Provisional Application No. 61/223,852 filed Jul. 8, 2009, the entire contents of which are incorporated herein by reference.

FIELD

Embodiments described herein relate generally to a toner cartridge that supplies toner to an image forming apparatus.

BACKGROUND

An image forming apparatus includes a toner cartridge to supply toner to a developing unit. The toner cartridge includes a cartridge body to contain toner, a stirring member contained in the cartridge body, and a screw disposed at the bottom of the cartridge body. The cartridge body includes a toner discharge port to discharge toner. The stirring member rotates in the cartridge body to stir the toner so that the toner is not solidified. The screw rotates in the cartridge body to carry the toner to the toner discharge port.

The stirring member used in the related art toner cartridge includes a rotation shaft supported by the cartridge body and a paddle rotating together with the rotation shaft. The paddle includes plural rod-like members constructed like a truss. The paddle includes two outer frames extending in the axial direction of the rotation shaft. When the rotation shaft rotates, the outer frames move along the inner surface of the cartridge body.

Further, the paddle includes a scraping sheet having elasticity. The scraping sheet is fixed to the one outer frame and projects from the outer frame to the inner surface of the cartridge body. When the paddle rotates, the scraping sheet scrapes the toner adhered to the inner surface of the cartridge body, and sends the scraped toner to the screw.

In a new toner cartridge stored for a long term, toner in the cartridge body is in a compressed state. Further, when the new toner cartridge is transported, there can occur a state where the toner in the cartridge body is solidified by vibration applied to the toner cartridge. Thus, the new toner cartridge is recommended to be shaken a predetermined number of times before it is mounted to an image forming apparatus and is used. When the toner cartridge is shaken, the toner in the cartridge body is loosened and the fluidity of the toner can be raised.

However, for example, when the user does not shake the toner cartridge as specified, it is supposed that the toner is not sufficiently loosened. When the toner is not sufficiently loosened, a lump of toner is mixed in the toner, and a part of the toner remains to be adhered to the inner surface of the cartridge body. Thus, when the stirring member rotates, the resistance of the toner applied to the stirring member is increased.

Specifically, since the outer frame of the stirring member moves along the inner surface of the cartridge body, the lump of toner is bitten between the outer frame and the inner surface of the cartridge body, or the outer frame inevitably strikes against the toner adhered to the inner surface of the cartridge body. As a result, the resistance to prevent the rotation of the stirring member is applied to the outer frame, and there can occur a state the stirring member is locked.

Further, the scraping sheet is made of a flexible resin film having elasticity. The flexible scraping sheet can not break the toner adhered to the inner surface of the cartridge body. Thus, the amount of toner remaining in the cartridge body is increased, and the toner in the cartridge body can not be completely used up.

DETAILED DESCRIPTION

In general, according to one embodiment, a toner cartridge includes a cartridge body, a stirring member configured to stir toner contained in the cartridge body, and a scraping member having elasticity. The stirring member includes a rotation shaft contained in the cartridge body, and plural stirring rods protruded from the rotation shaft and arranged in an axial direction of the rotation shaft. The stirring rods have tips opposite to an inner surface of the cartridge body. The tips of the stirring rods are separate from each other. The scraping member extends in the axial direction of the rotation shaft to scrape toner adhered to the inner surface of the cartridge body. The scraping member includes plural elastically deformable strips divided along the axial direction of the rotation shaft.

Figure 1:
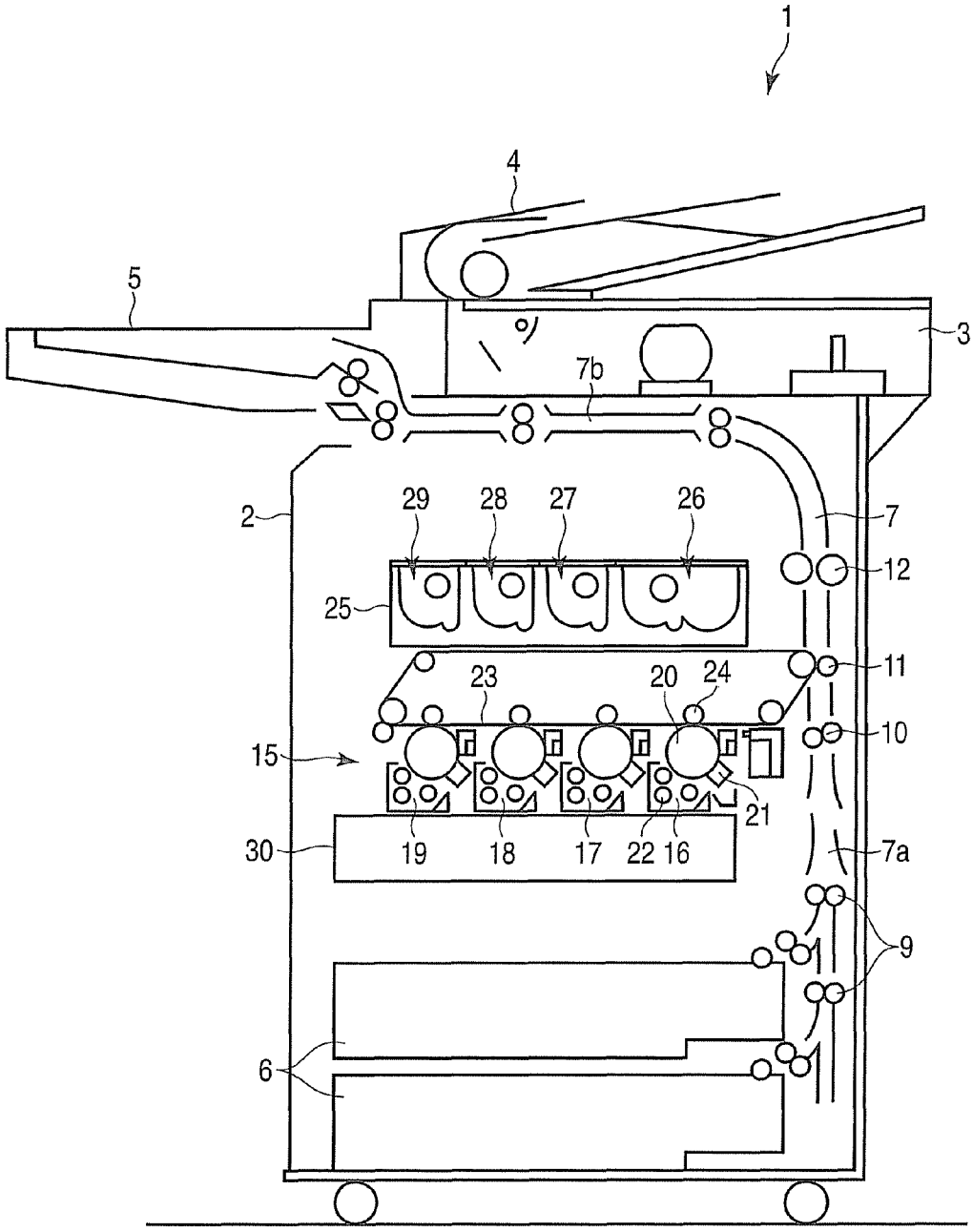
FIG. 1 is a side view schematically showing an image forming apparatus of an embodiment.
Figure 2:
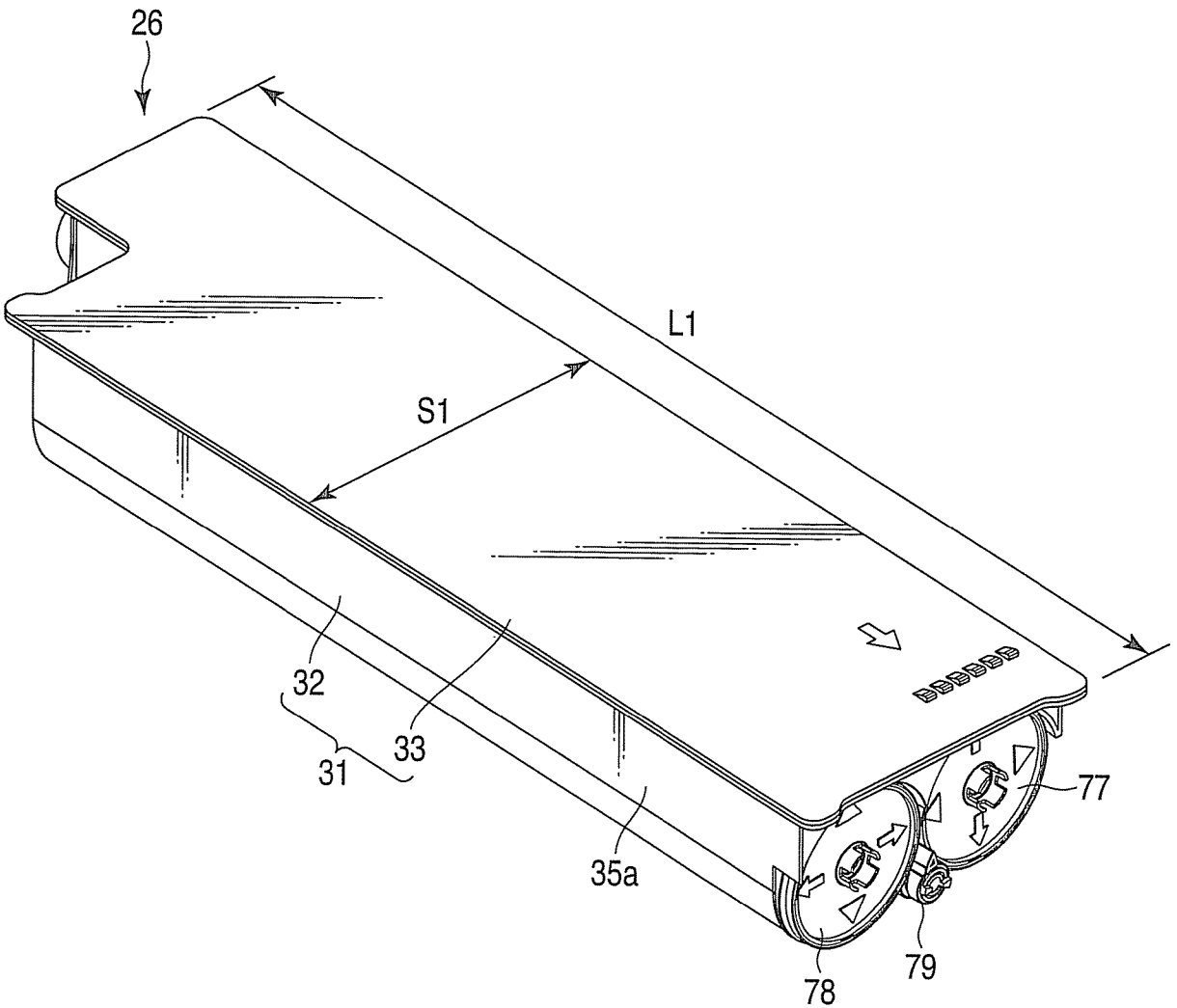
FIG. 2 is a perspective view of a toner cartridge of the embodiment.

FIG. 1 schematically shows an image forming apparatus 1 such as a four-drum tandem color copy machine. The image forming apparatus 1 includes an apparatus body 2. A scanner 3 to optically read image information such as characters from an original document, an automatic document feeder 4 to feed the original document to the scanner 3, and a paper discharge tray 5 are provided at an upper part of the apparatus body 2.

Plural paper feeding cassettes 6 are provided at a lower part of the apparatus body 2. The paper feeding cassettes 6 are connected to the paper discharge tray 5 through a carrying path 7. The carrying path 7 is for guiding sheets contained in the paper feeding cassettes 6 one by one to the paper discharge tray 5. The carrying path 7 includes a first path 7*a* and a second path 7*b*. The first path 7*a* extends upward from the paper feeding cassettes 6. The second path 7*b* extends horizontally from the upper end of the first path 7*a* to the paper discharge tray 5. Plural feeding rollers 9, a registration roller 10, a transfer roller 11 and a fixing unit 12 are provided on the first path 7*a* in sequence from below.

As shown in FIG. 1, an image forming section 15 is disposed at a middle of the apparatus body 2. The image forming section 15 includes a first image forming, unit 16 to form a black image, a second image forming unit 17 to form a cyan image, a third image forming unit 18 to form a magenta image, and a fourth image forming unit 19 to form a yellow image. The first to the fourth image forming units 16 to 19 are arranged in one line along the width direction of the apparatus body 2.

Each of the first to the fourth image forming units 16 to 19 includes a photosensitive drum 20, a charger 21 to charge the outer peripheral surface of the photosensitive drum 20, a developing unit 22 to develop an electrostatic latent image formed on the outer peripheral surface of the photosensitive drum 20 with toner, and an intermediate transfer roller 24 to transfer a toner image on the photosensitive drum 20 to an intermediate transfer belt 23. The intermediate transfer belt 23 passes between the photosensitive drum 20 and the intermediate transfer roller 24 of each of the first to the fourth image forming units 16 to 19, and is pressed to the transfer roller 11.

A cartridge receptacle 25 is disposed above the first to the fourth image forming units 16 to 19. A first to a fourth toner cartridges 26, 27, 28 and 29 are detachably received in the cartridge receptacle 25. The first toner cartridge 26 supplies black toner to the developing unit 22 of the first image forming unit 16. The second toner cartridge 27 supplies cyan toner to the developing unit 22 of the second image forming unit 17. The third toner cartridge 28 supplies magenta toner to the developing unit 22 of the third image forming unit 18. The fourth toner cartridge 29 supplies yellow toner to the developing unit 22 of the fourth image forming unit 19.

A laser unit 30 is disposed below the first to the fourth image forming units 16 to 19. The laser unit 30 irradiates light corresponding to image information to the photosensitive drums 20 of the first to the fourth image forming units 16 to 19. As a result, electrostatic latent images of colors to be developed are formed on the outer peripheral surfaces of the photosensitive drums 20 of the first to the fourth image forming units 16 to 19.

The electrostatic latent images formed on the photosensitive drums 20 of the first to the fourth image forming units 16 to 19 are respectively developed with toners of desired colors in the developing unit 22, and are visualized as toner images. The four color toner images are successively transferred to the intermediate transfer belt 23 by the intermediate transfer rollers 24, and are superimposed on the intermediate transfer belt 23.

When the four color toner images are transferred to the intermediate transfer belt 23, a sheet supplied from one paper feeding cassette 6 to the first path 7*a* of the carrying path 7 is guided to the position of the intermediate transfer belt 23 by the registration roller 10. The four color toner images superimposed on the intermediate transfer belt 23 are transferred to the sheet by the transfer roller 11. The full-color image transferred to the sheet is fixed to the sheet by the fixing unit 12. The sheet on which the full-color image is fixed is guided to the paper discharge tray 5 through the second path 7*b* of the carrying path 7.

In the first toner cartridge 26 filled with black toner, toner consumption is high as compared with the second to the fourth toner cartridges 27 to 29. Thus, the first toner cartridge 26 is constructed so that the filling amount of toner is larger than that of the second to the fourth toner cartridges 27 to 29. In the first to the fourth toner cartridges 27 to 29, a structure for discharging the filled toner is basically the same. Thus, in this embodiment, the structure of the first toner cartridge 26 will be described as a typical example.

As shown in FIG. 2 to FIG. 5, the first toner cartridge 26 includes a cartridge body 31. The cartridge body 31 is made of, for example, an opaque black synthetic resin material. The cartridge body 31 has a thin and long box shape having a long axis L1 along the depth direction of the image forming apparatus 1 and a short axis S1 along the width direction of the image forming apparatus 1. The cartridge body 31 is detachably inserted into the cartridge receptacle 25 from the front side of the image forming apparatus 1.

The cartridge body 31 includes a container 32 and a cover 33. The container 32 includes a left side wall 35*a*, a right side wall 35*b*, a bottom wall 36, a rear wall 37, a front wall 38 and an opening 39. The left side wall 35*a* and the right side wall 35*b* extend along the long axis L1 of the cartridge body 31, and are opposite to each other in the direction of the short axis S1. The bottom wall 36 extends between the lower end of the left side wall 35*a* and the lower end of the right side wall 35*b*. The rear wall 37 is positioned at one end of the cartridge body 31 along the direction of the long axis L1. The front wall 38 is positioned at the other end of the cartridge body 31 along the direction of the long axis L1. The opening 39 has a rectangular opening shape surrounded by the upper edges of the right and the left side walls 35*a* and 35*b*, the upper edge of the rear wall 37, and the upper edge of the front wall 38, and faces the bottom wall 36.

The cover 33 closes the opening 39 of the container 32. The cover 33 defines a toner receptacle 40 to contain black toner in the inside of the cartridge body 31 in cooperation with the container 32. A toner filling port 42 is formed in the front wall 38 of the container 32. The toner filling port 42 is for filling the black toner into the toner receptacle 40. The toner filling port 42 is closed by a cap 43 after filling of the toner is completed.

Figure 5:
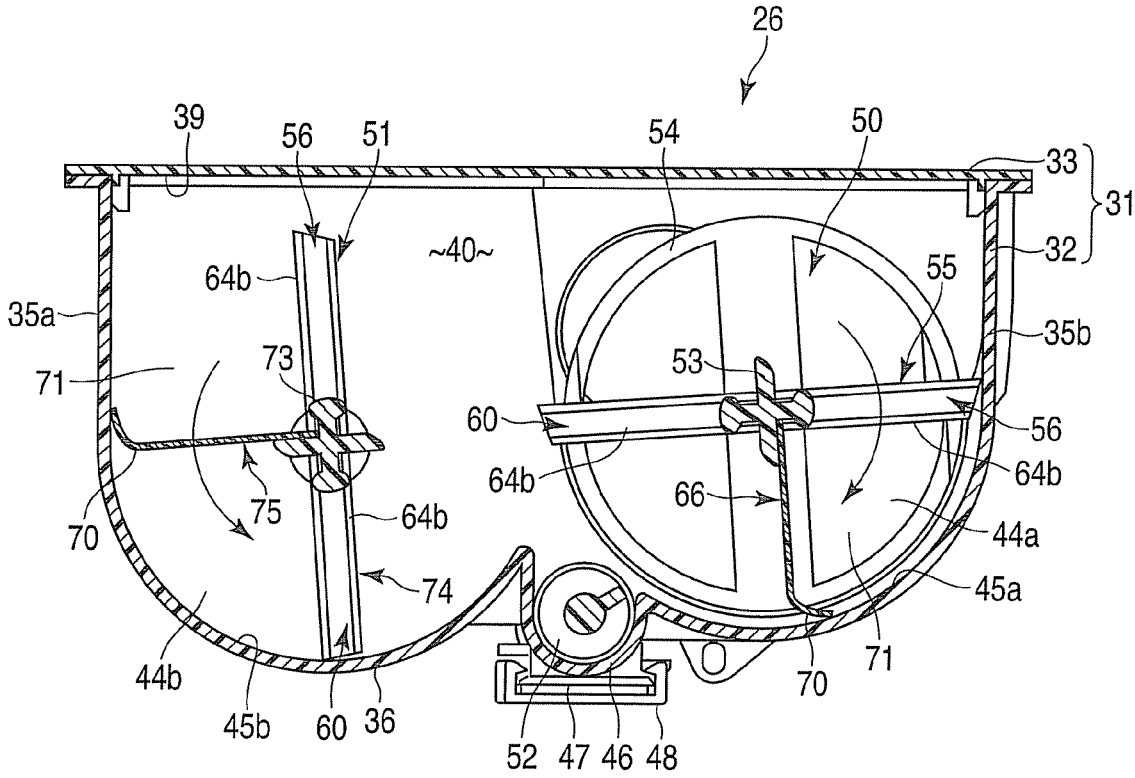
FIG. 5 is a sectional view along line F5-F5 of FIG. 4.

As shown in FIG. 5, the toner receptacle 40 includes a first toner containing area 44*a* and a second toner containing area 44*b*. The first and the second toner containing areas 44*a* and 44*b* extend along the long axis L1 of the cartridge body 31, and are arranged to be adjacent to each other in the direction of the short axis S1 of the cartridge body 31.

The bottom wall 36 of the container 32 includes a bottom surface 45*a* corresponding to the first toner containing area 44*a*, a bottom surface 45*b* corresponding to the second toner containing area 44*b*, and a recess 46. The bottom surfaces 45*a* and 45*b* are curved like an arc so as to project to the lower part of the container 32. The recess 46 is opened to the toner receptacle 40 between the bottom surfaces 45*a* and 45*b*, and extends straight in the direction of the long axis L1 of the cartridge body 31.

The recess 46 includes a toner discharge port 47. The toner discharge port 47 is for discharging the toner contained in the toner receptacle 40 to the outside of the cartridge body 31. The toner discharge port 47 is positioned at an end of the recess 46 adjacent to the front wall 38 of the container 32. Further, a shutter 48 is supported by the bottom wall 36 of the container 32. The shutter 48 can be slid between a close position of closing the toner discharge port 47 and an open position of opening the toner discharge port 47.

Figure 3:
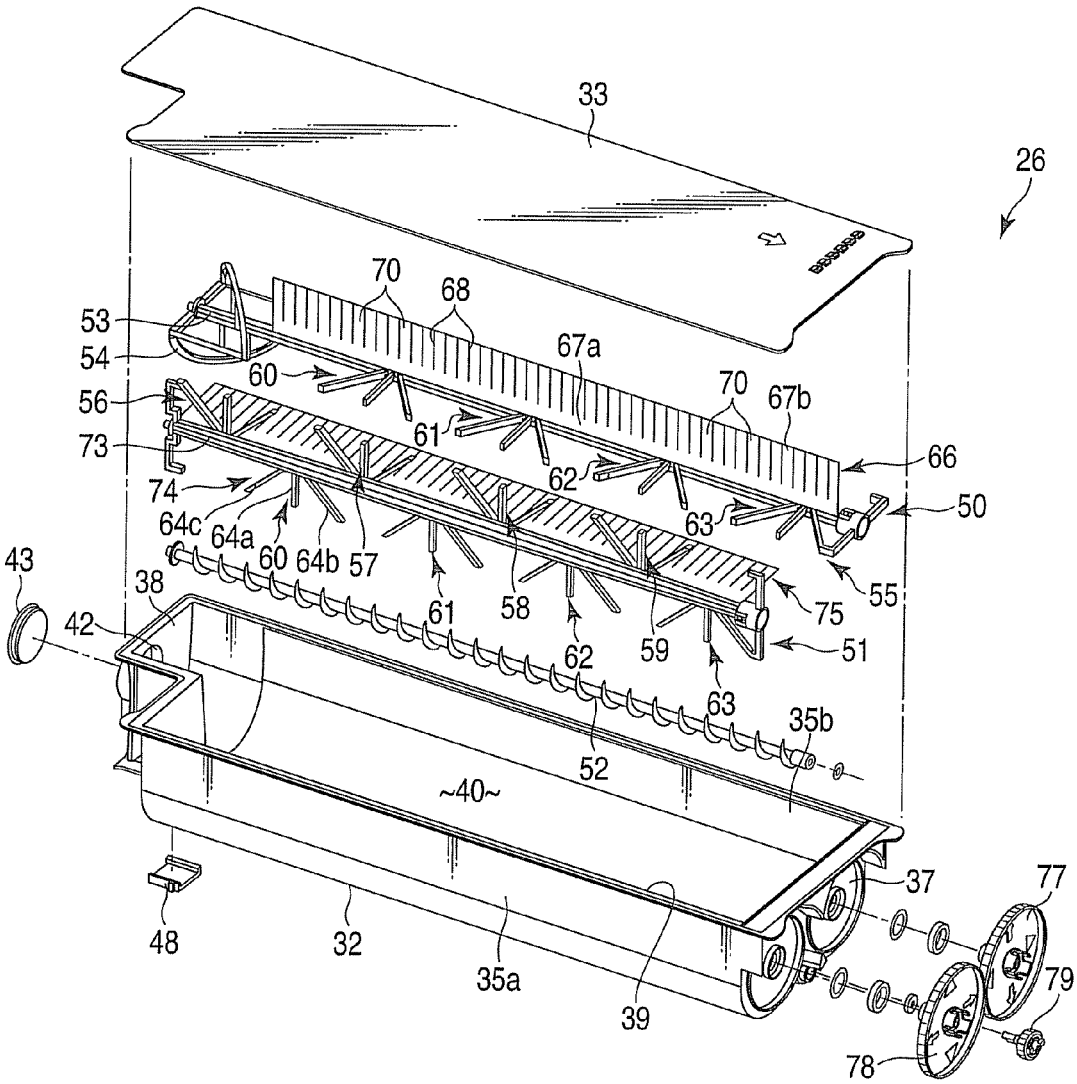
FIG. 3 is an exploded perspective view showing the toner cartridge of the embodiment.
Figure 4:
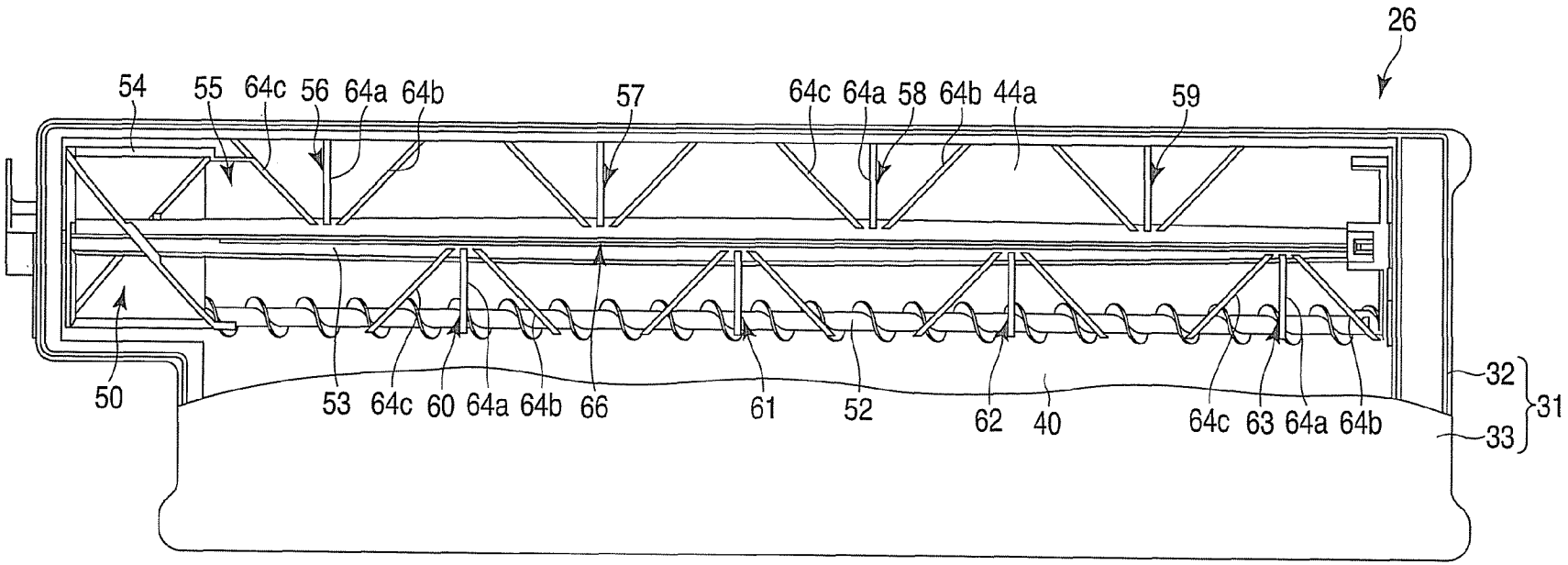
FIG. 4 is a plan view showing a positional relation between a first stirring member and a screw contained in the cartridge body.

As shown in FIG. 3 to FIG. 5, the first toner cartridge 26 includes a first and a second stirring members 50 and 51 to stir the toner filled in the toner receptacle 40, and a screw 52 to carry the toner filled in the toner receptacle 40 to the toner discharge port 47.

Figure 6:
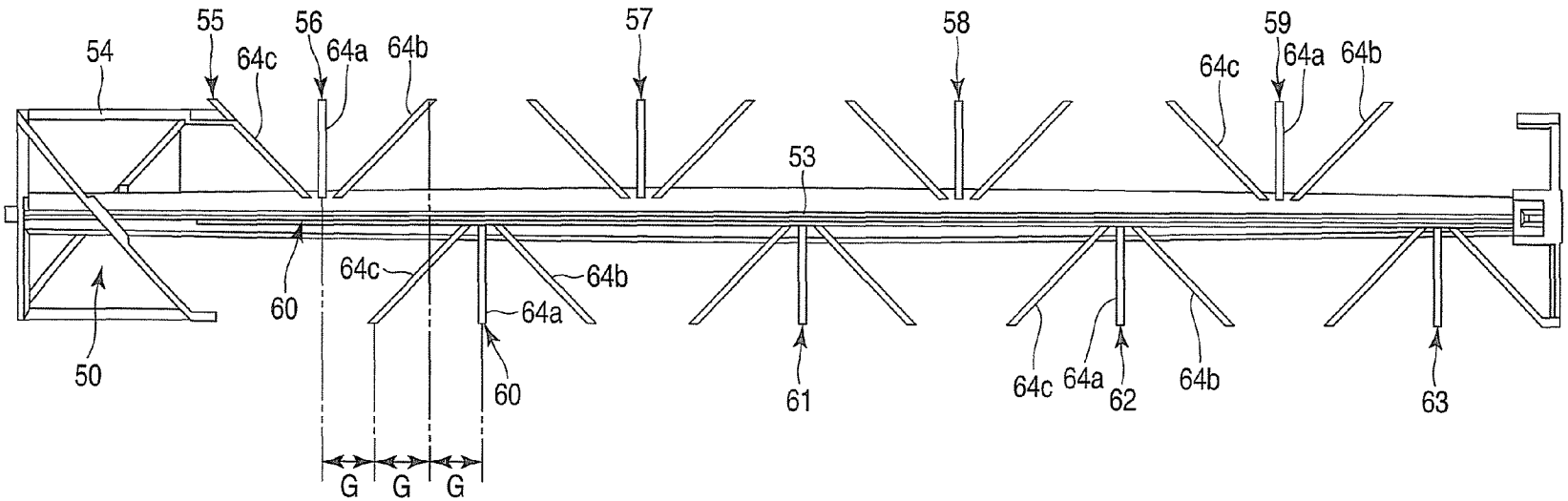
FIG. 6 is a plan view of the first stirring member used in the embodiment.

The first stirring member 50 is contained in the first toner containing area 44*a*. As shown in FIG. 4 to FIG. 6, the first stirring member 50 includes a rotation shaft 53, a carrying wing 54 and a paddle 55. The rotation shaft 53 extends between the rear wall 37 of the container 32 and the front wall 38. The carrying wing 54 is for sending toner to the toner discharge port 47. The carrying wing 54 is provided at the front end of the rotation shaft 53 so as to be adjacent to the toner discharge port 47.

The paddle 55 includes a first to an eighth rod blocks 56 to 63. The first to the fourth rod blocks 56, 57, 58 and 59 are arranged in one line in the axial direction of the rotation shaft 53 while an interval is provided therebetween, and protrude from the outer peripheral surface of the rotation shaft 53 to the inner surface of the container 32. The fifth to the eighth rod blocks 60, 61, 62 and 63 are disposed at positions shifted by 180° in the circumferential direction of the rotation shaft 53 from the first to the fourth rod blocks 56, 57, 58 and 59. The fifth to the eighth rod blocks 60, 61, 62 and 63 are arranged in one line in the axial direction of the rotation shaft 53 while an interval is provided therebetween, and protrude from the outer peripheral surface of the rotation shaft 53 to the inner surface of the container 32.

Further, the first to the fourth rod blocks 56, 57, 58 and 59 and the fifth to the eighth rod blocks 60, 61, 62 and 63 are relatively shifted from each other in the axial direction of the rotation shaft 53. Accordingly, as shown in FIG. 6, the first to the eighth rod blocks 56 to 63 are arranged zigzag in the axial direction of the rotation shaft 53.

Each of the first to the eighth rod blocks 56 to 63 includes a first to a third stirring rods 64*a*, 64*b* and 64*c*. The first to the third stirring rods 64*a*, 64*b* and 64*c* are arranged in one line in the axial direction of the rotation shaft 53. The first stirring rod 64*a* protrudes at right angles from the outer peripheral surface of the rotation shaft 53 in the diameter direction of the rotation shaft 53. The second stirring rod 64*b* protrudes from the outer peripheral surface of the rotation shaft 53 in the diameter direction of the rotation shaft 53, and is tilted so as to go away from the first stirring rod 64*a* as advancing in the direction of the protruding end. The third stirring rod 64*c* protrudes from the outer peripheral surface of the rotation shaft 53 in the diameter direction of the rotation shaft 53, and is tilted so as to go away from the first stirring rod 64*a* as advancing in the direction of the protruding end. As a result, the second stirring rod 64*b* and the third stirring rod 64*c* are tilted in reverse directions to each other with respect to the first stirring rod 64*a*.

Tips as the protruding ends of the first to the third stirring rods 64*a*, 64*b* and 64*c* are arranged in one line in the axial direction of the rotation shaft 53, and are separate from each other in the axial direction of the rotation shaft 53. Further, the tips of the first to the third stirring rods 64*a*, 64*b* and 64*c* slidably contact the inner surface of the container 32.

As shown in FIG. 6, when the first stirring member 50 is seen in plane, the second stirring rod 64*b* of the first rod block 56 and the third stirring rod 64*c* of the fifth rod block 60 are in such a positional relation that they overlap with each other in the axial direction of the rotation shaft 53. As a result, the tip of the first stirring rod 64*a* of the first rod block 56 and the tip of the third stirring rod 64*c* of the fifth rod block 60 are shifted from each other in the axial direction of the rotation shaft 53. Similarly, the tip of the second stirring rod 64*b* of the first rod block 56 is shifted from the tip of the first stirring rod 64*a* and the tip of the third stirring rod 64*c* of the fifth rod block 60 in the axial direction of the rotation shaft 53. The positional relation of the tips of the first to the third stirring rods 64*a*, 64*b* and 64*c* are common to all of the first to the eighth rod blocks 56 to 63 arranged in zigzag in the axial direction of the rotation shaft 53.

As a result, as indicated by a two-dot chain line in FIG. 6, the tips of the first to the third stirring rods 64*a*, 64*b* and 64*c* of the first to the eighth rod blocks 56 to 63 are arranged at regular intervals G in the axial direction of the rotation shaft 53.

As shown in FIG. 3 and FIG. 5, a scraping member 66 is attached to the outer peripheral surface of the rotation shaft 53. The scraping member 66 is made of, for example, a resin film having elasticity. The scraping member 66 is a thin and long sheet extending in the axial direction of the rotation shaft 53, and has the total length equal to the paddle 55. The thickness of the scraping member 66 is desirably, for example, 0.05 mm to 0.20 mm.

Figure 7:
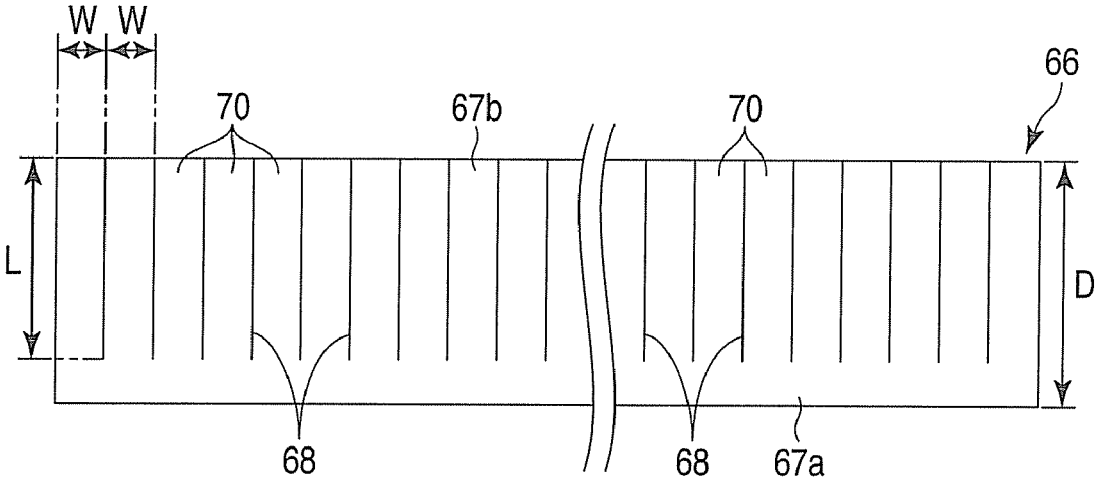
FIG. 7 is a plan view of a scraping member used in the embodiment.

As shown in FIG. 7, the scraping member 66 includes a first edge 67*a* and a second edge 67*b*. The first edge 67*a* is continuous in the axial direction of the rotation shaft 53. The second edge 67*b* is positioned at the opposite side to the first edge 67*a*, and extends in the axial direction of the rotation shaft 53. The first edge 67*a* of the scraping member 66 is fixed to the outer peripheral surface of the rotation shaft 53 by, for example, a double-sided adhesive tape. According to this embodiment, the scraping member 66 projects to the inner surface of the container 32 from the outer peripheral surface of the rotation shaft 53 at a position shifted from the paddle 55 by 90° in the peripheral direction of the rotation shaft 53.

As shown in FIG. 7, plural cut lines 68 are formed in the scraping member 66. The cut lines 68 extend in the direction perpendicular to the longitudinal direction of the scraping member 66, and are arranged in one line in the longitudinal direction of the scraping member 66 while an interval is provided therebetween. Further, the cut lines 68 are opened at the second edge 67*b* of the scraping member 66. Accordingly, the scraping member 66 includes plural strips 70 divided by the cut lines 68.

The strips 70 can be elastically deformed independently of each other. Each of the strips 70 has a width size W along the axial direction of the rotation shaft 53 and a length size L along the diameter direction of the rotation shaft 53. The width sizes W of the strips 70 are equal to each other and are smaller than the interval G between the tips of the first to the third stirring rods 64*a*, 64*b* and 64*c*. The length size L of the strip 53 has such a value that the free end of the strip 70 at the opposite side to the rotation shaft 53 contacts the inner surface of the container 32. Further, the length size L of the strip 70 is desirably 70% to 90% of the total length D of the scraping member 66 from the first edge 67*a* of the scraping member 66 to the second edge 67*b*.

As shown in FIG. 5, the scraping member 66 is shifted from the paddle 55 by 90° in the circumferential direction of the rotation shaft 53. In other words, the scraping member 66 is positioned upstream of the first to the fourth rod blocks 56 to 59 of the paddle 55 along the rotation direction of the rotation shaft 53. Thus, an area 71 for allowing the strip 70 to be displaced when the strip 70 is deformed is secured between the strip 70 of the scraping member 66 and the first to the fourth rod blocks 56 to 59.

The second stirring member 51 is contained in the second toner containing area 44*b*. The second stirring member 51 has the same structure as the first stirring member 50 except that a component corresponding to the carrying wing 54 of the first stirring member 50 does not exist. Specifically, the second stirring member 51 includes a rotation shaft 73, a paddle 74 and a scraping member 75. The rotation shaft 73 extends between the rear wall 37 of the container 32 and the front wall 38, and is disposed in parallel to the rotation shaft 53 of the first stirring member 50. The paddle 74 has the same structure as the paddle 55 of the first stirring member 50.

Thus, in this embodiment, respective components of the paddle 74 are denoted by the same reference numerals as those of the paddle 55 and their description is omitted. Similarly, since the scraping member 75 has the same structure as the scraping member 66 of the first stirring member 50, respective components of the scraping member 75 are denoted by the same reference numerals as those of the scraping member 66 and their description is omitted.

As shown in FIG. 3, a first gear 77 is coaxially fixed to the rear end of the rotation shaft 53 of the first stirring member 50.

Similarly, a second gear 78 is coaxially fixed to the rear end of the rotation shaft 73 of the second stirring member 51. The first gear 77 and the second gear 78 are engaged with each other at the outside of the rear wall 37 of the container 32. Thus, as indicated by arrows in FIG. 5, the first stirring member 50 and the second stirring member 51 synchronously rotate in reverse directions to each other.

The screw 52 is an example of a carrying member and is contained in the recess 46 of the container 32. The screw 52 passes above the toner discharge port 47. The screw 52 extends between the rear wall 37 of the container 32 and the front wall 38, and is rotatably supported by the container 32. A drive gear 79 is coaxially fixed to the rear end of the screw 52. The drive gear 79 is engaged with the second gear 78 rotating integrally with the second stirring member 51 at the outside of the rear wall 37 of the container 32. Further, when the first toner cartridge 26 is inserted into the cartridge receptacle 25 of the apparatus body 2, the drive gear 79 is engaged with a coupling of a drive module of the apparatus body 2.

When torque of the drive module is transmitted to the drive gear 79 through the coupling, the screw 52, together with the drive gear 79, rotates. Further, the torque of the drive module is transmitted from the drive gear 79 to the first and the second stirring members 50 and 51 through the first and the second gears 77 and 78, and the first and the second stirring members 50 and 51 are rotated in synchronization with the screw 52.

In this embodiment, in the first and the second stirring members 50 and 51, the phases of the paddles 55 and 74 are shifted from each other by 90° in the rotation directions of the rotation shafts 53 and 73 in order to prevent mutual interference of the paddles 55 and 74. Similarly, also in the scraping members 66 and 75, the phases along the rotation directions of the rotation shafts 53 and 73 are shifted from each other by 90°.

According to the first toner cartridge 26 as described above, the first and the second stirring members 50 and 51 to stir the toner include the first to the eighth rod blocks 56 to 63 arranged zigzag in the axial direction of the rotation shafts 53 and 73. Each of the rod blocks 56 to 63 includes the first to the third stirring rods 64*a*, 64*b* and 64*c* protruding from the outer peripheral surface of the rotation shaft 53 or 73. The tips of the first to the third stirring rods 64*a*, 64*b* and 64*c* are not coupled to each other but are separated from each other, and respectively slidably contact the inner surfaces of the side walls 35*a* and 35*b* of the container 32 and the inner surface of the bottom wall 36 when the rotation shafts 53 and 73 rotate. Thus, the first to the third stirring rods 64*a*, 64*b* and 64*c* break the toner or a lump of toner adhered to the inner surfaces of the side walls 35*a* and 35*b* and the inner surface of the bottom wall 36, and crush the toner into pieces.

The first to the third stirring rods 64*a*, 64*b* and 64*c* are independent of each other and protrude from the outer peripheral surfaces of the rotation shafts 53 and 73. Thus, when the first and the second stirring members 50 and 51 rotate, load applied to the first to the eighth rod blocks 56 to 63 is reduced. As a result, the resistance of the toner to prevent the rotation of the first and the second stirring members 50 and 51 is reduced, and the lock of the first and the second stirring members 50 and 51 can be avoided.

Further, the scraping members 66 and 75 fixed to the outer peripheral surfaces of the rotation shafts 53 and 73 move in accordance with the rotation of the rotation shafts 53 and 73 and contact the inner surfaces of the side walls 35*a* and 35*b* and the inner surface of the bottom wall 36. As a result, the toner remaining on the inner surfaces of the side walls 35*a* and 35*b* and the inner surface of the bottom wall 36 is scraped by the scraping members 66 and 75 and is sent to the screw 52.

In addition, the plural strips 70 of the scraping members 66 and 75 can be elastically deformed independently of each other. Thus, for example, when compressed toner which is not completely broken by the paddles 55 and 74 partially adheres to the inner surfaces of the side walls 35*a* and 35*b* and the inner surface of the bottom wall 36, the strip 70 corresponding to the compressed toner is deformed to ride on the compressed toner. As a result, the resistance of the toner applied to the scraping members 66 and 75 can be relieved by the deformation of the strip 70, and the load applied to the first and the second stirring members 50 and 51 can be reduced.

In addition, in this embodiment, the area 71 for allowing the displacement of the strips 70 of the scraping member 66, 75 is formed between the scraping member 66, 75 and the first to the fourth rod blocks 56 to 59 of the paddle 55, 74. Thus, even when the strip 70 is deformed to ride on the compressed toner, it is possible to prevent the strip 70 from interfering with the paddle 55, 74. Thus, the load applied to the scraping members 66 and 75 can be reduced, and the rotation of the first and the second stirring members 50 and 51 is not damaged.

The compressed toner is stirred by the paddles 55 and 74 of the first and the second stirring members 50 and 51 several times, and is broken by the first to the eighth rod blocks 56 to 63. Thus, a transition is made to a state in which all the strips 70 of the scraping members 66 and 75 contact the inner surfaces of the side walls 35*a* and 35*b* and the inner surface of the bottom wall 36. Thus, the toner remaining on the inner surfaces of the side walls 35*a* and 35*b* and the inner surface of the bottom wall 36 is efficiently scraped by the scraping members 66 and 75 and can be sent to the screw 52.

Accordingly, even if the toner contained in the first toner cartridge 26 is compressed, while the lock of the first and the second stirring members 50 and 51 is prevented, the toner can be supplied to the developing unit 22 of the image forming apparatus 1 without waste and efficiently.

The inventor engaged in the development of the toner cartridge performed a test to check whether a toner supply operation was normally performed in the toner cartridge including the first and the second stirring members as described in the embodiment. In this test, four kinds of toner cartridges of example 1 to example 4 and seven kinds of toner cartridges of comparative example 1 to comparative example 7 as shown in Table 1 were prepared, and the toner supply operation, the toner remaining state and the existence of a toner lump to influence image formation were checked for each of the toner cartridges.

TABLE 1

| | Shape of paddle | Relation between interval G of stirring rod and width W of strip | Ratio (%) of length of strip to total length of scraping member | Thickness of stirring member | Toner supply operation | Toner remaining state | Existence of toner lump |
|---|---|---|---|---|---|---|---|
| Ex. 1 | FIG. 6 | G > W | 90 | 0.10 | ○ | ○ | ○ |
| Ex. 2 | FIG. 6 | G > W | 70 | 0.20 | ○ | ○ | ○ |

TABLE 1-continued

| | Shape of paddle | Relation between interval G of stirring rod and width W of strip | Ratio (%) of length of strip to total length of scraping member | Thickness of stirring member | Toner supply operation | Toner remaining state | Existence of toner lump |
|---|---|---|---|---|---|---|---|
| Ex. 3 | FIG. 6 | G > W | 80 | 0.05 | ○ | ○ | ○ |
| Ex. 4 | FIG. 6 | G > W | 80 | 0.15 | ○ | ○ | ○ |
| Com. Ex. 1 | Related art type | G > W | 80 | 0.15 | x | Unmeasurable | Unmeasurable |
| Com. Ex. 2 | FIG. 6 | G > W | 80 | 0.25 | x | Unmeasurable | Unmeasurable |
| Com. Ex. 3 | FIG. 6 | G > W | 80 | 0.04 | ○ | x | ○ |
| Com. Ex. 4 | FIG. 6 | G < W | 80 | 0.15 | x | Unmeasurable | Unmeasurable |
| Com. Ex. 5 | FIG. 6 | G > W | 95 | 0.10 | x | Unmeasurable | Unmeasurable |
| Com. Ex. 6 | FIG. 6 | G > W | 65 | 0.20 | ○ | ○ | x |
| Com. Ex. 7 | Nothing | — | 80 | 0.10 | ○ | x | Unmeasurable |

In the toner cartridge of example 1, the paddle having the shape shown in FIG. 6 is used, and the thickness of the scraping member is 0.10 mm. Further, the ratio (L/D×100) of the length L of the strip to the total length D of the scraping member is 90%.

In the toner cartridge of example 2, the paddle having the shape shown in FIG. 6 is used, and the thickness of the scraping member is 0.20 mm. Further, the ratio (L/D×100) of the length L of the strip to the total length D of the scraping member is 70%.

In the toner cartridge of example 3, the paddle having the shape shown in FIG. 6 is used, and the thickness of the scraping member is 0.05 mm. Further, the ratio (L/D×100) of the length L of the strip to the total length D of the scraping member is 80%.

In the toner cartridge of example 4, the paddle having the shape shown in FIG. 6 is used, and the thickness of the scraping member is 0.15 mm. Further, the ratio (L/D×100) of the length L of the strip to the total length D of the scraping member is 80%.

On the other hand, in the toner cartridge of comparative example 1, the related art type paddle having the outer frame is used, and the thickness of the scraping member is 0.15 mm. Further, the ratio (L/D×100) of the length L of the strip to the total length D of the scraping member is 80%.

In the toner cartridge of comparative example 2, the paddle having the shape shown in FIG. 6 is used, and the thickness of the scraping member is 0.25 mm. Further, the ratio (L/D×100) of the length L of the strip to the total length D of the scraping member is 80%.

In the toner cartridge of comparative example 3, the paddle having the shape shown in FIG. 6 is used, and the thickness of the scraping member is 0.04 mm. Further, the ratio (L/D×100) of the length L of the strip to the total length D of the scraping member is 80%.

In the toner cartridge of comparative example 4, the paddle having the shape shown in FIG. 6 is used, and the thickness of the scraping member is 0.15 mm. Further, the ratio (L/D×100) of the length L of the strip to the total length D of the scraping member is 80%. The width W of each of the strips is wider than the interval G of the stirring rod.

In the toner cartridge of comparative example 5, the paddle having the shape shown in FIG. 6 is used, and the thickness of the scraping member is 0.10 mm. Further, the ratio (L/D×100) of the length L of the strip to the total length D of the scraping member is 95%.

In the toner cartridge of comparative example 6, the paddle having the shape shown in FIG. 6 is used, and the thickness of the scraping member is 0.20 mm. Further, the ratio (L/D×100) of the length L of the strip to the total length D of the scraping member is 65%.

In the toner cartridge of comparative example 7, the paddle is removed from the rotation shaft. The thickness of the scraping member is 0.10 mm, and the ratio (L/D×100) of the length L of the strip to the total length D of the scraping member is 80%.

In this test, in each of the toner cartridges of example 1 to example 4 and the toner cartridges of comparative example 1 to comparative example 7, a predetermined amount of toner is filled in the toner receptacle of the toner cartridge. Further, the toner cartridge in which the toner discharge port is directed downward is dropped to the floor from a height of 5 cm and a shock is directly applied to the toner cartridge 500 times. Thereafter, the toner cartridge is mounted to the cartridge receptacle of the image forming apparatus and a normal toner supply operation is performed.

As shown in Table 1, in the toner cartridges of example 1 to example 4, as a result of performing the toner supply operation until the toner in the toner cartridge is exhausted, it is confirmed that a defect does not occur in the toner supply operation, and the toner is properly supplied from the toner discharge port. Further, at the time point when the toner in the toner cartridge is exhausted, the amount of residual toner adhered to the inner surface of the cartridge body is zero. In addition, it is confirmed that problems such as a defective image due to a toner lump do not occur.

On the other hand, in the toner cartridge of comparative example 1, at the time of the toner supply operation, an abnormal sound is generated from the inside of the toner cartridge, and the operation of the image forming apparatus is stopped. When the toner cartridge is extracted from the cartridge receptacle of the image forming apparatus and is checked, it is confirmed that the stirring member is locked and is not moved. In the toner cartridge of comparative example 1, since the related art type paddle having the outer frame is used, it is estimated that a large load to prevent the rotation of the stirring member is generated in the outer frame of the paddle, and the stirring member is locked.

In the toner cartridge of comparative example 2, at the time of the toner supply operation, an abnormal sound is generated from the inside of the toner cartridge, and the operation of the image forming apparatus is stopped. When the toner cartridge is extracted from the cartridge receptacle of the image forming apparatus and is checked, it is confirmed that the stirring member is locked and is not moved. In the toner cartridge of comparative example 2, the scraping member is thicker than the scraping member of example 1 to example 4. In the thick scraping member, the elastic force is so strong, that the scraping member can not be quickly deformed when the scraping member rides on the compressed toner. It is estimated that as a result of this, the resistance of the toner applied to the scraping member can not be relieved, and a large load is generated in the scraping member.

In the toner cartridge of comparative example 3, as a result of performing the toner supply operation until the toner in the toner cartridge is exhausted, it is confirmed that problems such as a defective image due to the toner supply operation and a toner lump do not occur. However, it is confirmed that the amount of residual toner adhered to the inner surface of the cartridge body is large. In comparative example 3, the scraping member is thinner than the scraping member of example 1 to example 4. The thin scarping member has low elastic force and is liable to be bent, and it is difficult to secure the contact pressure to the inner surface of the cartridge body. It is estimated that as a result of this, the toner adhered to the inner surface of the cartridge body can not be scraped off by the scraping member.

In the toner cartridge of comparative example 4, at the time of the toner supply operation, an abnormal sound is generated from the inside of the toner cartridge, and the operation of the image forming apparatus is stopped. When the toner cartridge is extracted from the cartridge receptacle of the image forming apparatus and is checked, it is confirmed that the stirring member is locked and is not moved. In the toner cartridge of comparative example 4, the interval between the tips of the stirring rods is narrower than the width of the strip of the scraping member. Thus, it is estimated that the compressed toner can not be sufficiently broken by the stirring rods, and a large load is generated in the scraping member.

In the toner cartridge of comparative example 5, at the time of the toner supply operation, an abnormal sound is generated from the inside of the toner cartridge, and the operation of the image forming apparatus is stopped. When the toner cartridge is extracted from the cartridge receptacle of the image forming apparatus and is checked, it is confirmed that the stirring member is locked and is not moved. As a result of decomposing the toner cartridge of comparative example 5, it is founded that the scraping member comes off from the rotation shaft and is wound around the rotation shaft. In the toner cartridge of comparative example 5, the ratio of the length of the strip to the total length of the scraping member is large, and the contact area between the scraping member and the rotation shaft is insufficient. It is estimated that as a result of this, when the scraping member rotates, the scraping member comes off from the rotation shaft by the resistance of the toner applied to the scraping member and the stirring member is locked.

In the toner cartridge of comparative example 6, as a result of performing the toner supply operation until the toner in the toner cartridge is exhausted, it is confirmed that there is no problem in the toner supply operation and the amount of residual toner. However, it is confirmed that a defective image due to a toner lump is generated. As a result of checking the inside of the toner cartridge, it is confirmed that plural contact traces which appear to be formed by contact of the strips of the scraping member exist on the inner surface of the cartridge body. According to the toner cartridge of comparative example 6, since the ratio of the length of the strip to the total length of the scraping member is small, the length of the strip is shorter than the strip of example 1 to example 4. As a result, when the strips contact the inner surface of the cartridge body, the respective strips are hard to be warped, and it is estimated that a large load to cause a toner lump to be produced is applied to the inner surface of the cartridge body.

In the toner cartridge of comparative example 7, as a result of performing the toner supply operation until the toner in the toner cartridge is exhausted, it is confirmed that an abnormal sound is not generated from the image forming apparatus. However, the toner is not supplied to the developing unit of the image forming apparatus, and it is indicated on the control panel of the image forming apparatus that toner is empty. As a result of investigating the inside of the toner cartridge, it is found that the compressed toner remains as it is, and the scraping member is wound around the rotation shaft. In the toner cartridge of comparative example 7, since there is no paddle to break the compressed toner, it is estimated that the scraping member is forcibly pressed to the rotation shaft by the compressed toner.

Accordingly, the conclusion is that in order to certainly carry the toner broken by the stirring rods to the toner discharge port by the scraping member, it is desirable that the length L of the strip is 70% to 90% of the total length D of the scraping member, and the thickness of the scraping member is 0.05 mm to 0.20 mm.

In this embodiment, the plural stirring rods are not limited to be arrange in one line in the axial direction of the rotation shaft. For example, an area where the scraping member extending in the axial direction of the rotation shaft is secured above the outer peripheral surface of the rotation shaft, and plural stirring rods may be protruded from the outer peripheral surface of the rotation shaft radially and at random.

Further, in this embodiment, the toner receptacle of the cartridge body includes the first and the second toner containing areas, and the first and the second scraping members are contained in the first and the second toner containing areas. However, the structure of the toner cartridge is not limited to that of the embodiment, but, for example, one stirring member may be contained in one toner containing area.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A toner cartridge comprising:

a cartridge body to contain toner;

a stirring member configured to stir the toner contained in the cartridge body, in which the stirring member includes a rotation shaft contained in the cartridge body, and a plurality of stirring rods protruded from the rotation shaft and arranged in an axial direction of the rotation shaft, the stirring rods have tips opposite to an inner surface of the cartridge body, and the tips of the stirring rods are separate from each other; and a scraping member rotating together with the rotation shaft and having elasticity, in which the scraping member extends in the axial direction of the rotation shaft to scrape toner adhered to the inner surface of the cartridge body, and includes a plurality of elastically deformable strips divided along the axial direction of the rotation shaft.

2. The toner cartridge of claim 1, wherein the scraping member protrudes from the rotation shaft to the inner surface of the cartridge body, and the strips of the scraping member have tips elastically contacting the inner surface of the cartridge body and elastically deformable independently of each other.

3. The toner cartridge of claim 2, wherein the scraping member includes a first edge continuous in the axial direction of the rotation shaft, a second edge positioned at an opposite side to the first edge, and a plurality of cut lines arranged in the axial direction of the rotation shaft, spaced from each other by an interval and opened in the second edge to form the strips, and the first edge is fixed to an outer peripheral surface of the rotation shaft.

4. The toner cartridge of claim 3, wherein the strips of the scraping member have width sizes along the axial direction of the rotation shaft, and the width sizes of the strips are equal to each other.

5. The toner cartridge of claim 4, wherein each of the width sizes of the strips is smaller than an interval between the tips of the stirring rods.

6. The toner cartridge of claim 3, wherein the scraping member is made of a resin film having a thickness of 0.05 mm to 0.20 mm.

7. The toner cartridge of claim 6, wherein a length of the strip of the scraping member is 70% to 90% of a total length of the scraping member from the first edge of the scraping member to the second edge.

8. The toner cartridge of claim 1, wherein the tips of the stirring rods are arranged in one line in the axial direction of the rotation shaft and are spaced from each other by an interval.

9. The toner cartridge of claim 8, wherein the tips of the stirring rods contact the inner surface of the cartridge body.

10. The toner cartridge of claim 1, wherein the scraping member protrudes from the rotation shaft in a direction crossing the stirring rods, and an area configured to allow the strips to be displaced when the strips of the scraping member are elastically deformed is secured between the scraping member and the stirring rods.

11. A toner cartridge comprising:

a toner receptacle to contain toner and having a toner discharge port;

a carrying member configured to carry the toner contained in the toner receptacle to the toner discharge port;

a stirring member configured to stir the toner contained in the toner receptacle, in which the stirring member includes a rotation shaft contained in the toner receptacle, and a plurality of stirring rods protruded from the rotation shaft and arranged in an axial direction of the rotation shaft, the stirring rods have tips opposite to an inner surface of the toner receptacle, and the tips of the stirring rods are separate from each other; and a scraping member rotating together with the rotation shaft and having elasticity, in which the scraping member scrapes toner adhered to the inner surface of the toner receptacle and sends the toner to the carrying member, and includes a plurality of elastically deformable strips divided along the axial direction of the rotation shaft.

12. The toner cartridge of claim 11, wherein the strips of the scraping member respectively have width sizes along the axial direction of the rotation shaft, and each of the width sizes of the strips is smaller than an interval between the tips of the stirring rods.

13. The toner cartridge of claim 12, wherein the scraping member protrudes from the rotation shaft to the inner surface of the toner receptacle, and the strips of the scraping member have tips elastically contacting the inner surface of the toner receptacle and elastically deformable independently of each other.

14. An image forming apparatus comprising:

an image forming unit including a developing unit; and a toner cartridge configured to supply toner to the developing unit, wherein the toner cartridge comprises (i) a toner receptacle to contain toner, (ii) a stirring member to stir the toner contained in the toner receptacle, in which the stirring member includes a rotation shaft contained in the toner receptacle, and a plurality of stirring rods protruded from the rotation shaft and arranged in an axial direction of the rotation shaft, the stirring rods have tips opposite to an inner surface of the toner receptacle, and the tips of the stirring rods are separate from each other, and (iii) a scraping member rotating together with the rotation shaft and having elasticity, in which the scraping member extends in the axial direction of the rotation shaft to scrape toner adhered to the inner surface of the toner receptacle, and includes a plurality of elastically deformable strips divided along the axial direction of the rotation shaft.

* * * * *